US011143398B2

(12) United States Patent
Lankinen

(10) Patent No.: US 11,143,398 B2
(45) Date of Patent: Oct. 12, 2021

(54) BOILER SYSTEM WITH A SUPPORT CONSTRUCTION

(71) Applicant: SUMITOMO SHI FW ENERGIA OY, Espoo (FI)

(72) Inventor: Pentti Lankinen, Varkaus (FI)

(73) Assignee: Sumitomo SHI FW Energia Oy, Espoo (FI)

( * ) Notice: Subject to any disclaimer, the term of this patent is extended or adjusted under 35 U.S.C. 154(b) by 0 days.

(21) Appl. No.: 16/754,943

(22) PCT Filed: Nov. 1, 2017

(86) PCT No.: PCT/EP2017/077987
§ 371 (c)(1),
(2) Date: Apr. 9, 2020

(87) PCT Pub. No.: WO2019/086112
PCT Pub. Date: May 9, 2019

(65) Prior Publication Data
US 2020/0263869 A1 Aug. 20, 2020

(51) Int. Cl.
*F22B 37/24* (2006.01)

(52) U.S. Cl.
CPC ..... *F22B 37/24* (2013.01)

(58) Field of Classification Search
CPC ..... F22B 37/24; F22B 37/244; F22B 37/207; F16L 3/00; F16L 3/23; F28F 9/007; F28F 9/0075
See application file for complete search history.

(56) References Cited

U.S. PATENT DOCUMENTS 2,583,599 A 1/1952 Schoessow
2,856,906 A 10/1958 Armacost
(Continued)

FOREIGN PATENT DOCUMENTS

DE 1426718 A1 1/1970
DE 4017253 A1 12/1991
(Continued)

OTHER PUBLICATIONS

Office Action and Search Report dated Oct. 23, 2020, issued in corresponding Russian Patent Application No. 2020117052.
(Continued)

*Primary Examiner* — Gregory A Wilson
(74) *Attorney, Agent, or Firm* — Venable LLP

(57) ABSTRACT

A boiler system includes a support construction and a furnace supported to the support construction at a vertically middle section of the furnace, the furnace being enclosed by water tube walls having two side walls and two end walls, a roof and a bottom, the side walls having a total height (H) from the bottom to the roof. Each of the two side walls has a vertical upper portion that extends from the roof to a level of thirty to seventy percent of the height (H), a lower portion that extends from the bottom to a level of thirty to seventy percent of the height (H) and has a vertical upper portion, and an in downward direction outwards bent intermediate portion at a level between the upper portion of the side wall and the vertical upper portion of the lower portion of the side wall. The support construction includes horizontal wall supporting beams that are arranged parallel to the side walls at a level below the roof of the furnace and directly above the vertical upper portions of the lower portions of the two side walls, and the furnace is supported to the support construction by having the intermediate portions of the side
(Continued)

walls connected to adjacent horizontal wall supporting beams so as to balance vertical loads of the furnace.

18 Claims, 6 Drawing Sheets

(56) References Cited

U.S. PATENT DOCUMENTS

| | | | | | |
|---|---|---|---|---|---|
| 4,428,329 | A * | 1/1984 | Rees | F22B 37/244 | 122/235.12 |
| 4,940,025 | A * | 7/1990 | Ott | F22B 37/248 | 122/510 |
| 5,143,024 | A * | 9/1992 | Yokoyama | F22B 31/0038 | 122/24 |
| 7,240,640 | B2 * | 7/2007 | Kinnunen | F22B 37/244 | 122/450 |
| 8,020,297 | B2 * | 9/2011 | Yoshino | F22B 37/24 | 29/890.031 |
| 9,739,475 | B2 * | 8/2017 | Magee | F22B 37/107 | |
| 2015/0024105 | A1 | 1/2015 | Perlman | | |

FOREIGN PATENT DOCUMENTS

| | | | | | |
|---|---|---|---|---|---|
| DE | 19821587 | A1 | | 11/1999 | |
| EP | 0073851 | A1 | | 3/1983 | |
| GB | 1069545 | A | | 5/1967 | |
| JP | S58-60105 | A | | 4/1983 | |
| JP | S63-233202 | A | | 9/1988 | |
| JP | 06323504 | A | * | 11/1994 | F22B 37/244 |
| JP | H10-267207 | A | | 10/1998 | |
| JP | 2000-193189 | A | | 7/2000 | |
| RU | 2381416 | C1 | | 2/2010 | |
| RU | 2494307 | C2 | | 9/2013 | |
| SU | 1755002 | A1 | | 8/1992 | |
| WO | 2004/048849 | A1 | | 6/2004 | |
| WO | 2007/068802 | A2 | | 6/2007 | |
| WO | 2010/116040 | A2 | | 10/2010 | |
| WO | WO-2019215383 | A1 | * | 11/2019 | F22B 37/143 |

OTHER PUBLICATIONS

Notification of and International Search Report and Written Opinion dated Jul. 4, 2018, in corresponding International Patent Application No. PCT/EP2017/077987.

Notification of and International Preliminary Reporton Patentability dated Oct. 22, 2019, in corresponding International Patent Application No. PCT/EP2017/077987.

Office Action dated Mar. 19, 2021, issued in corresponding Indian Patent Application No. 202047021919.

Examination Report dated Jun. 15, 2021, issued in corresponding Australian Patent Application No. 2017437709.

Office Action dated May 20, 2021, issued in Chinese Patent Application No. 201780096296.3 (with English translation).

Office Action dated Aug. 9, 2021, issued in European Patent Application No. 17793641.6.

Office Action dated Jul. 20, 2021, issued in Indian Patent Application No. P00202003741.

Office Action dated Jul. 11, 2021, issued in Japanese Patent Application No. 2020-520003 (with English translation).

Office Action dated Jul. 19, 2021, issued in Korean Patent Application No. 10-2020-7014819 (with English translation).

* cited by examiner

BOILER SYSTEM WITH A SUPPORT CONSTRUCTION

CLAIM OF PRIORITY

This application is a U.S. national stage application of International Patent Application No. PCT/EP2017/077987, filed Nov. 1, 2017, now published as International Publication No. WO 2019/086112 A1 on May 9, 2019.

BACKGROUND OF THE INVENTION

Field of the Invention

The present invention relates to a boiler system that includes a furnace and a support construction. More particularly, the invention relates to a boiler system comprising a support construction and a furnace supported to the support construction at a middle section of the furnace, the furnace being enclosed by water tube walls comprising two side walls and two end walls, a roof and a bottom, the side walls having a total height H from the bottom to the roof, wherein each of the two side walls comprises a vertical upper portion that extends from the roof to a level of thirty to seventy percent of the height H, a lower portion that extends from the bottom to a level of thirty to seventy percent of the height H and has a vertical upper portion, and an in downward direction outwards bent intermediate portion at a level between the upper portion of the side wall and the vertical upper portion of the lower portion of the side wall.

Description of Related Art

Relatively large boilers are conventionally arranged to be top-supported, i.e., they are supported so that the furnace of the boiler is arranged to hang from a support construction, usually, a rigid support steel structure, extending around and above the furnace. Relatively small boilers are conventionally arranged to be bottom-supported, wherein a vertical load of the furnace is balanced by a support construction arranged below the boiler. The main difference between the top-supported and bottom-supported constructions is that when the temperature of the furnace increases, thermal expansion of a top-supported boiler takes place mainly downwards, whereas in a bottom-supported boiler thermal expansion takes place mainly upwards. Bottom-supported boilers are in the case of relatively small boilers generally simpler and economically more advantageous than top-supported boilers, because they do not require a separate support construction extending around and above the furnace. A disadvantage of the bottom-supported construction is that the walls of the furnace have to be strong enough to carry the vertical compression load of the furnace.

A third alternative is to support the furnace at its middle section, to a rigid support construction. Thereby, the lower portion of the furnace, below the middle section, is top-supported, and the upper portion of the furnace, above the middle section, is bottom supported. Middle-supported construction is advantageous for some applications while it reduces the size of the support steel structure from that needed around the furnace of a top-supported boiler. Simultaneously, such a middle-supported construction eliminates the need for very strong walls of the furnace as in large bottom-supported boilers. Different middle-supported boiler constructions are shown, for example, in U.S. Pat. Nos. 2,583,599, 2,856,906, European patent publication EP 0073851 A1, and U.S. Patent Application Publication No. 2015/0241054.

U.S. Pat. No. 4,428,329 discloses a middle supported boiler construction with a support steel structure comprising multiple fixed cantilever arms at an intermediate height of the boiler. In order to absorb horizontal thermal expansion, the tubewalls of the furnace are hanging from multiple levers flexibly connected to the cantilever arms by a number of vertical links attached to an in downward direction outwards bent section of the tubewall. International Publication No. WO 2004/048849 discloses a boiler system with a combustion section, a heat exchange section arranged above the combustion section, and a stationary supporting structure, which sections are separately hung from their upper part to the stationary supporting structure.

A problem in designing middle-supported boilers is to find a simple and advantageous way to attach the middle section of the furnace to a rigid support construction around the furnace and simultaneously take into account the effects of horizontal thermal expansion.

An object of the present invention is to provide a boiler system having an advantageous support construction for a middle-supported furnace.

SUMMARY OF THE INVENTION

According to one aspect, the present invention provides a boiler system comprising a support construction and a furnace supported to the support construction at a vertically middle section of the furnace, the furnace being enclosed by water tube walls comprising two side walls and two end walls, a roof and a bottom, the side walls having a total height H from the bottom to the roof, wherein each of the two side walls comprises a vertical upper portion that extends from the roof to a level of thirty to seventy percent of the height H, a lower portion that extends from the bottom to a level of thirty to seventy percent of the height H and has a vertical upper portion, and an in downward direction outwards bent intermediate portion at a level between the upper portion of the side wall and the vertical upper portion of the lower portion of the side wall, wherein the support construction comprises horizontal wall supporting beams that are arranged parallel to the side walls at a level below the roof of the furnace and directly above the vertical upper portions of the lower portions of the two side walls, and the furnace is supported to the support construction by having the intermediate portions of the side walls connected to adjacent horizontal wall supporting beams so as to balance vertical loads of the furnace.

To enable efficient and reliable supporting of the furnace, for example, the furnace of a fluidized bed boiler, at an intermediate height of the furnace, at a vertically middle section of the side walls of the furnace is arranged an in downward direction outwards bent intermediate portion. Due to the outwards bent intermediate portion of the side walls, it is possible to arrange horizontal supporting beams, hereafter called horizontal wall supporting beams, directly above the vertical upper portions of the lower portions of the side walls, and to support the side walls vertically to the horizontal wall supporting beams.

The support construction advantageously comprises two horizontal wall supporting beams, one adjacent to each of the sidewalls. Thereby, the length of the horizontal wall supporting beams is generally at least as long as the width of the sidewalls. In some applications, it may also be possible to use piecewise horizontal wall supporting beams, whereby, for example, adjacent to each of the sidewalls are arranged two horizontal wall supporting beams, one after the other. The supporting of the sidewalls is advantageously made by a plurality of short vertical hanger rods connected between the outwards bent intermediate portions of the sidewalls and the respective horizontal wall supporting beams.

A main feature of the present invention is that the furnace is middle-supported, i.e., that vertical loads, such as gravitational forces and seismic forces, affecting the furnace are balanced to a rigid support construction at an intermediate height, between the bottom and roof, of the furnace. Because of the middle-supporting, the lower portion of the furnace, below the middle section, is top-supported, and the upper portion of the furnace, above the middle section, is bottom supported. Thus, when the temperature of the furnace increases from ambient temperature to the normal operating temperature, such as 850 degrees Celsius, the upper portion of the furnace expands, typically, by more than ten centimeters, upwards, and the lower portion of the furnace expands similarly downwards. However, thermal expansion of the furnace naturally also takes place in the horizontal direction. Therefore, the supporting of the middle-supported furnace has to be performed so as to be able to also absorb the horizontal thermal expansion.

A similar in downward direction outward bent intermediate portion at a level between the upper portion and lower portion of the side wall of a middle-supported furnace is also shown in U.S. Pat. No. 4,428,329. In the solution shown in U.S. Pat. No. 4,428,329, however, groups of the water tubes of the side walls are supported by vertical links via multiple horizontal thermal expansion absorbing levers to corresponding fixed cantilever arms. U.S. Pat. No. 4,428,329 does not teach supporting the tube walls to horizontal wall supporting beams arranged parallel to the side walls directly above the vertical lower portions of the side walls.

To render possible, simple and reliable horizontal thermal expansion absorbing supporting of the furnace at an intermediate height of the furnace, the support construction advantageously comprises a first portion having multiple vertical columns supported to the foundations of the boiler system and multiple fixed horizontal beams firmly supported to the vertical columns and a second portion movably connected to the first portion and comprising the horizontal wall supporting beams. According to a preferred embodiment of the present invention, each of the horizontal wall supporting beams is movably supported to at least two of the fixed horizontal beams, which at least two fixed horizontal beams are arranged to be parallel to the end walls of the furnace.

The horizontal wall supporting beams are preferably arranged at a level below the roof of the furnace, more preferably, at a level of thirty to seventy percent, even more preferably, at a level of forty to sixty percent, of the height H from the bottom of the furnace. The horizontal wall supporting beams are advantageously connected to fixed horizontal beams of the support construction located nearly at the same level as the horizontal wall supporting beams, either below the horizontal wall supporting beams or slightly above the horizontal wall supporting beams. Thereby, the supporting arrangement of the present invention renders it possible to use a simple and an economically advantageous fixed support construction having a clearly lower height than that of a conventional support construction of a top-supported furnace, which extends to a level clearly higher than the roof of the furnace.

It may, in some embodiments of the present invention, be possible to supplement the above described middle-supporting of the furnace by flexible auxiliary top-supporting or bottom-supporting, but, in any case, according to the present invention, most of the vertical loads of the furnace are balanced by the middle-support. According to a preferred embodiment of the present invention, vertical loads of the furnace are balanced solely by the horizontal wall supporting beams. The expression that a furnace is supported solely by the horizontal wall supporting beams does not mean that there are no connections to the surrounding structures, but that such other connections, such as devices for conveying flue gas from the furnace or water to the water tubes, or devices for feeding air and fuel to the furnace, do not provide any essential balancing of vertical loads of the furnace.

As mentioned above, the support construction advantageously comprises multiple vertical columns supported to the foundations of the boiler system, multiple fixed horizontal beams firmly supported to the vertical columns and horizontal wall supporting beams, which are movably supported to at least two of the multiple fixed horizontal beams, which are arranged parallel to the end walls of the furnace. The at least two fixed horizontal beams advantageously comprise at least two of one or more horizontal beams arranged outside of the end walls of the furnace and one or more cantilever beams protruding towards a central portion of a side wall of the furnace.

Horizontal wall supporting beams having a length greater than the width of the side walls of the furnace are usually supported to fixed horizontal beams arranged outside of the end walls of the furnace. In case the width of the side walls is relatively large, for example, as in a fluidized bed boiler with two or more particle separators side by side, the horizontal wall supporting beams are advantageously also supported to at least one fixed cantilever beam protruding toward a central portion of the respective side wall. Usually, the number of cantilevers on each side wall is one fewer than the number of adjacent particle separators, whereby there is a cantilever beam between each pair of separators. When using one after the other arranged piecewise wall supporting beams, it is naturally necessary to support at least the inward ends of the piecewise wall supporting beams to cantilever beams protruding towards a central portion of the respective side wall.

The temperature of the horizontal wall supporting beams advantageously follows the temperature of the furnace. Therefore, according to a preferred embodiment of the present invention, the horizontal wall supporting beams are arranged inside a common thermal insulation with the furnace. This arrangement provides the advantage that the horizontal wall supporting beams stay, in all conditions, nearly at the same temperature as that of the furnace, and the thermal expansion of the horizontal wall supporting beams is nearly the same as the thermal expansion of the furnace.

Due to the nearly same temperature of the horizontal wall supporting beams and the furnace, there is no need for a flexible connection of the watertube walls to the horizontal wall supporting beams. Instead, it is possible to hang the furnace from the two horizontal wall supporting beams simply by multiple relatively short hanger rods that are connected to the side walls of the furnace. Preferably, the length of the hanger rods is at most two meters, even more preferably, at most one meter.

The hanger rods are advantageously attached to the two side walls by a support lug. The support lug is advantageously welded to the edge between the lower end of the intermediate portion of the side wall and the upper end of the vertical upper portion of the lower portion of the side wall. The lug is advantageously designed so as to have the hanger rod aligned with the vertical upper portion of the lower portion of the respective side wall. Because the horizontal wall supporting beams stay in all conditions closely at the same temperature as that of the furnace, the hanger rods stay, in practice, aligned with the vertical upper portions of the lower portions of the side walls.

The support lugs of the hanger rods are welded close to each other to the tubes or fins of the tubewall of the side wall. In order to provide a nearly uniform support to the furnace, the distance between adjacent hanger rods is advantageously a small multiple of the distance between adjacent water tubes of the water tube wall. The distance of the hanger rods is thus N times the distance between adjacent water tubes of the water tube wall, where N is a small integer. Preferably, N is at most three, more preferably, at most two, and even more preferably, N is one.

On the other hand, the horizontal wall supporting beams do not stay at the same temperature as the fixed support construction. Therefore, it is necessary to connect the horizontal wall supporting beams to the fixed support construction in a differential horizontal thermal expansion allowing way. Correspondingly, according to an advantageous embodiment of the present invention, each of the horizontal wall supporting beams is supported on sliding surfaces arranged on the at least two fixed horizontal beams.

According to another advantageous embodiment of the present invention, each of the horizontal wall supporting beams is supported to be hanging from the at least two fixed horizontal beams arranged parallel to the end walls of the furnace. Advantageously, each of the two horizontal wall supporting beams is supported to be hanging by at least two main hanger rods from the at least two fixed horizontal beams. The main hanger rods are generally relatively long so as to enable sufficient tilting of the main hanger rods to absorb the differential horizontal thermal expansion caused by relative movement between the fixed horizontal beams and the horizontal wall supporting beams. The length of the main hanger rods is thus, preferably, at least three meters, even more preferably, at least five meters.

The present invention renders possible an especially straightforward design of the boiler, clearly faster erection of the boiler than by using conventional methods, and, in many cases, a remarkable reduction in the quantities of the required steel structures.

The above brief description, as well as further objects, features, and advantages of the present invention will be more fully appreciated by reference to the following detailed description of the currently preferred, but nonetheless illustrative, embodiments in accordance with the present invention, when taken in conjunction with the accompanying drawings.

DETAILED DESCRIPTION OF THE INVENTION

Figure 1:
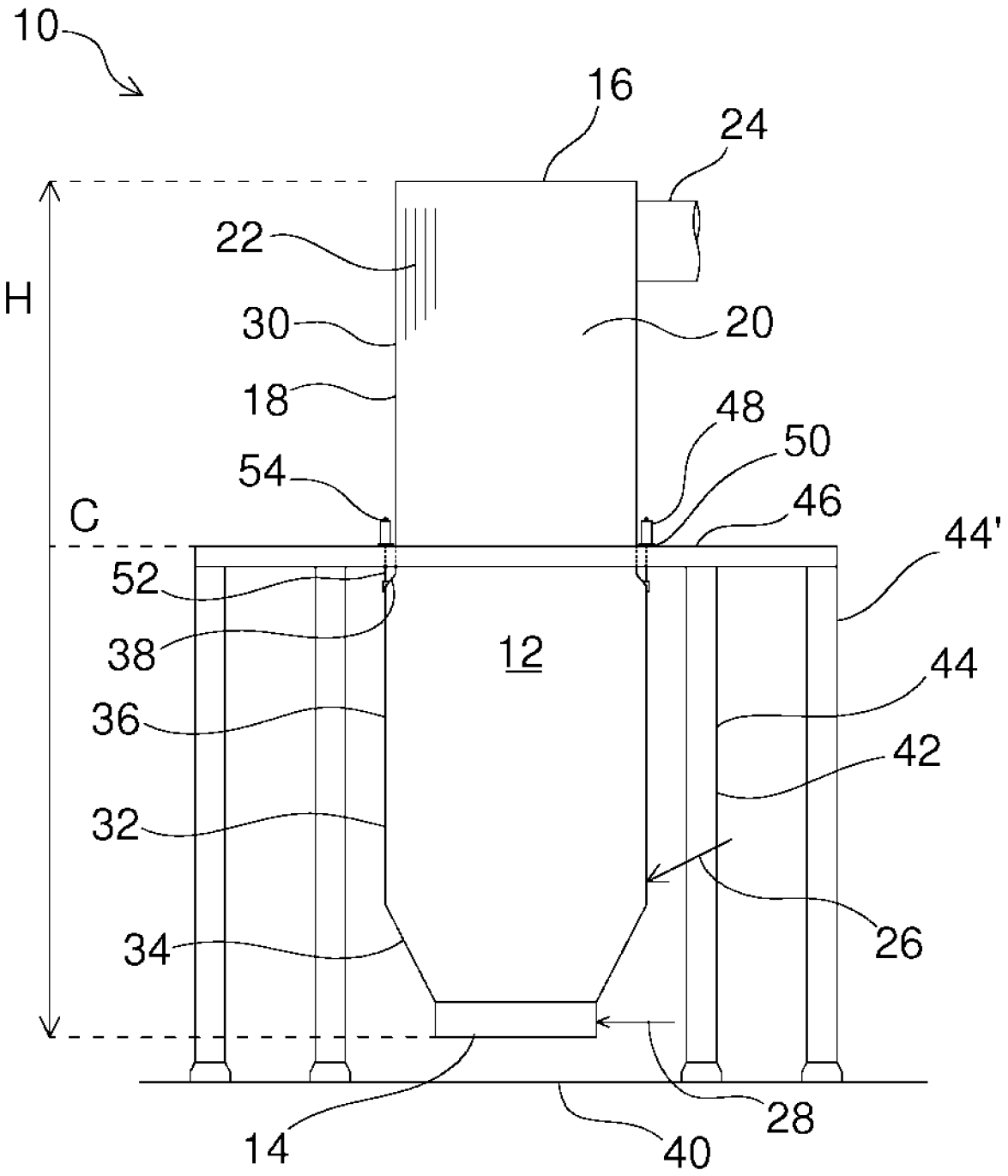
FIG. 1 schematically illustrates a side view of a boiler system according to a preferred embodiment of the present invention.

FIG. 1 schematically illustrates a side view of a fluidized bed boiler system 10, in accordance with an embodiment of the present invention. The fluidized bed boiler system 10 comprises a furnace 12 having a bottom 14 and a roof 16 at a height H from the bottom, two side walls 18 and two end walls 20, only one of which is seen in FIG. 1. The side walls 18 and end walls 20 are of a conventional type, consisting of vertical water tubes 22 connected together by fins. The boiler can be either a drum boiler or a once-through boiler. The furnace 12 also comprises other conventional equipment, such as a flue gas duct 24 and a device for feeding fuel 26 and primary air 28 to the furnace. Because such equipment is not relevant for understanding the present invention, they are not described here in detail.

The side walls 18 comprise a vertical upper portion 30 and a lower portion 32 with an inwards slanted bottom portion 34 and a vertical upper portion 36. Between the vertical upper portion 30 and the vertical upper portion 36 of the lower portion 32 of the side wall 18, there is an in downward direction outwards bent intermediate portion 38.

Figure 2:
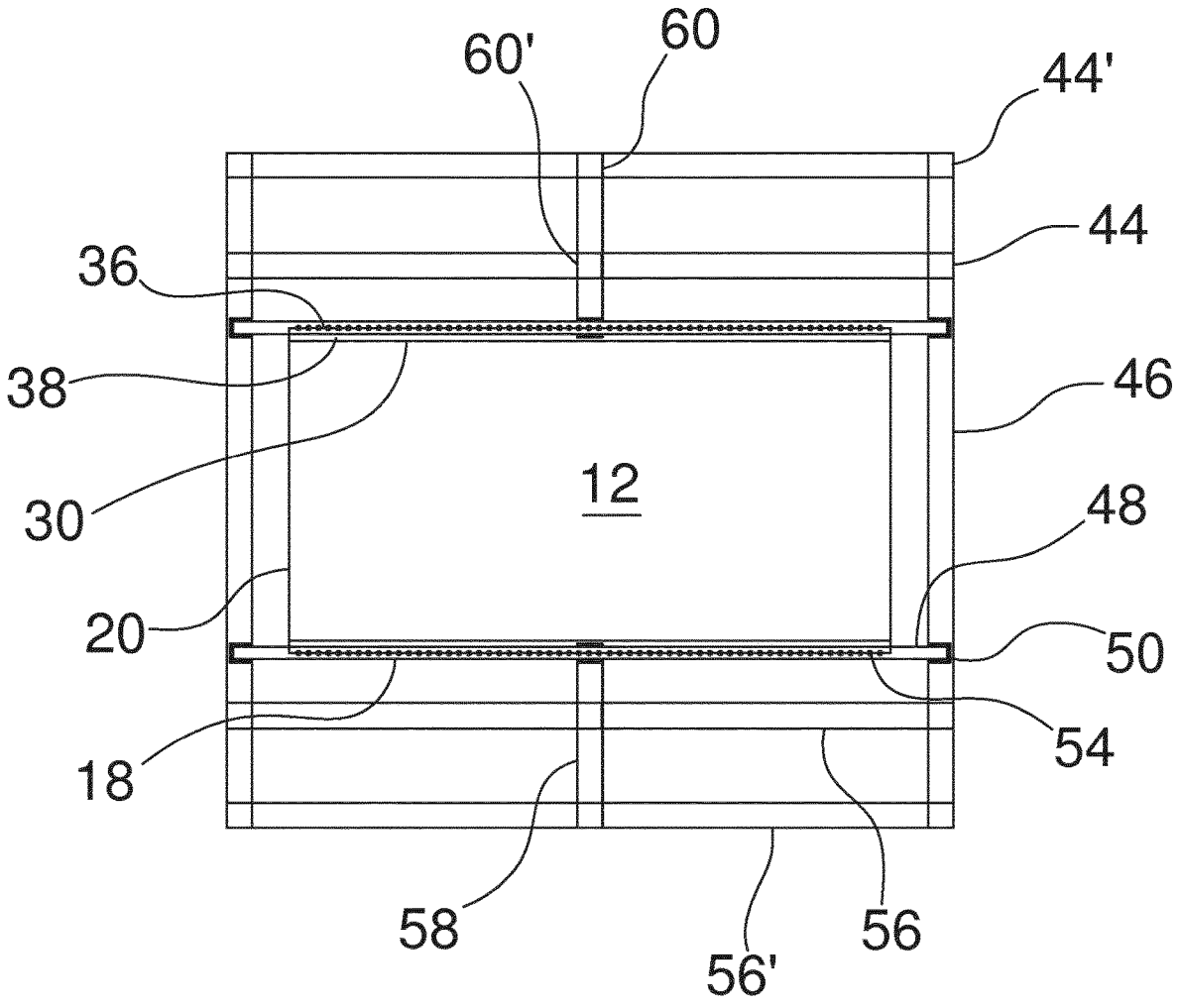
FIG. 2 schematically illustrates a horizontal top view of the boiler system of FIG. 1.

In the case of a fluidized bed boiler system 10 having a rectangular furnace 12 enclosed by two longer walls and two shorter walls, the shorter walls, which are generally vertical, are usually considered to be the end walls. Thus, the supporting of the furnace 12 according to the present invention is made on the longer walls, which are considered to be the side walls. A cross section of such a furnace is seen in FIG. 2. On the other hand, the furnace 12 of a circulating fluidized bed boiler with only one particle separator usually has an at least nearly square cross section. In such a case, any two of the enclosing walls can be considered to be the side walls as in the present description, i.e., the supporting of the furnace according to the present invention can be made on any two mutually opposing walls of the enclosing walls.

The furnace 12 is supported to the ground 40 by a support construction 42 that comprises multiple vertical columns 44 supported to the ground 40 and multiple fixed horizontal beams 46 firmly attached to the vertical columns 44. The support construction 42 also comprises horizontal wall supporting beams 48 arranged parallel to the side walls 18. In addition to the inner vertical columns 44 close to the furnace 12, there are also usually, for example, outer vertical columns 44', which are needed to provide support to other equipment of the boiler system 10, such as a steam drum, fuel bins, or particle separators (not shown in FIG. 1).

The horizontal wall supporting beams 48 are arranged slidingly, by using suitable sliding surfaces 50, on two fixed horizontal beams 46 arranged parallel to the end walls 20. As can been seen from FIG. 2, there can also be cantilever beams 58 protruding towards central sections of the sidewalls 18 for providing additional support to the horizontal wall supporting beams 48. The same reference numbers are generally used for the same or corresponding elements in each of FIGS. 1 to 6.

The horizontal wall supporting beams 48 are arranged close to the outwards bent intermediate wall portions 38, directly above the vertical upper portions 36 of the lower portions 32 of the side walls 18. The furnace 12 is then supported by hanging the side walls 18 of the furnace from the horizontal wall supporting beams 48 by multiple short hanger rods 52.

The horizontal wall supporting beams 48 are resting on the fixed horizontal beams 46 at a level C that is vertically at a middle section of the furnace 12. When the furnace 12 heats up from ambient temperature to the operating temperature, such as 850 degrees Celsius, thermal expansion lengthens the height and width of the furnace 12. When the furnace 12 is middle-supported, as shown in FIG. 1, the middle portion of the furnace 12 remains at its original level, and the upper portion of the furnace 12, upwards from the level C, expands upwards, and the lower portion of the furnace 12, downwards from the level C, expands downwards. In addition to the vertical expansion, the furnace 12 also experiences thermal expansion in the horizontal direction. The effect and absorption of horizontal thermal expansion will be considered below.

The level C is clearly below the roof of the furnace, preferably, at a level of thirty to seventy percent, even more preferably, at a level of forty to sixty percent, of the height H from the bottom of the furnace. The total height of the support construction 42 can thereby be clearly less than that of a conventional top-supported furnace 12, in which the support construction extends clearly above the roof of the furnace 12.

FIG. 2 is a horizontal top view of the boiler system of FIG. 1. As is seen in FIG. 2, the end walls 20 of the furnace 12 are shorter than the side walls 18. In addition to the fixed horizontal beams 46 outside and parallel to the end walls 20, there are also inner and outer fixed horizontal beams 56, 56' outside and parallel to the side walls 18. There are also additional inner and outer vertical columns 60, 60' to support the inner and outer fixed horizontal beams 56, 56' and cantilever beams 58 protruding towards the side walls 18. In practice, the furnace of a fluidized bed with more than one particle separator arranged on a side wall of the furnace 12 has a cantilever beam 58 between each pair of adjacent particle separators.

Figure 3:
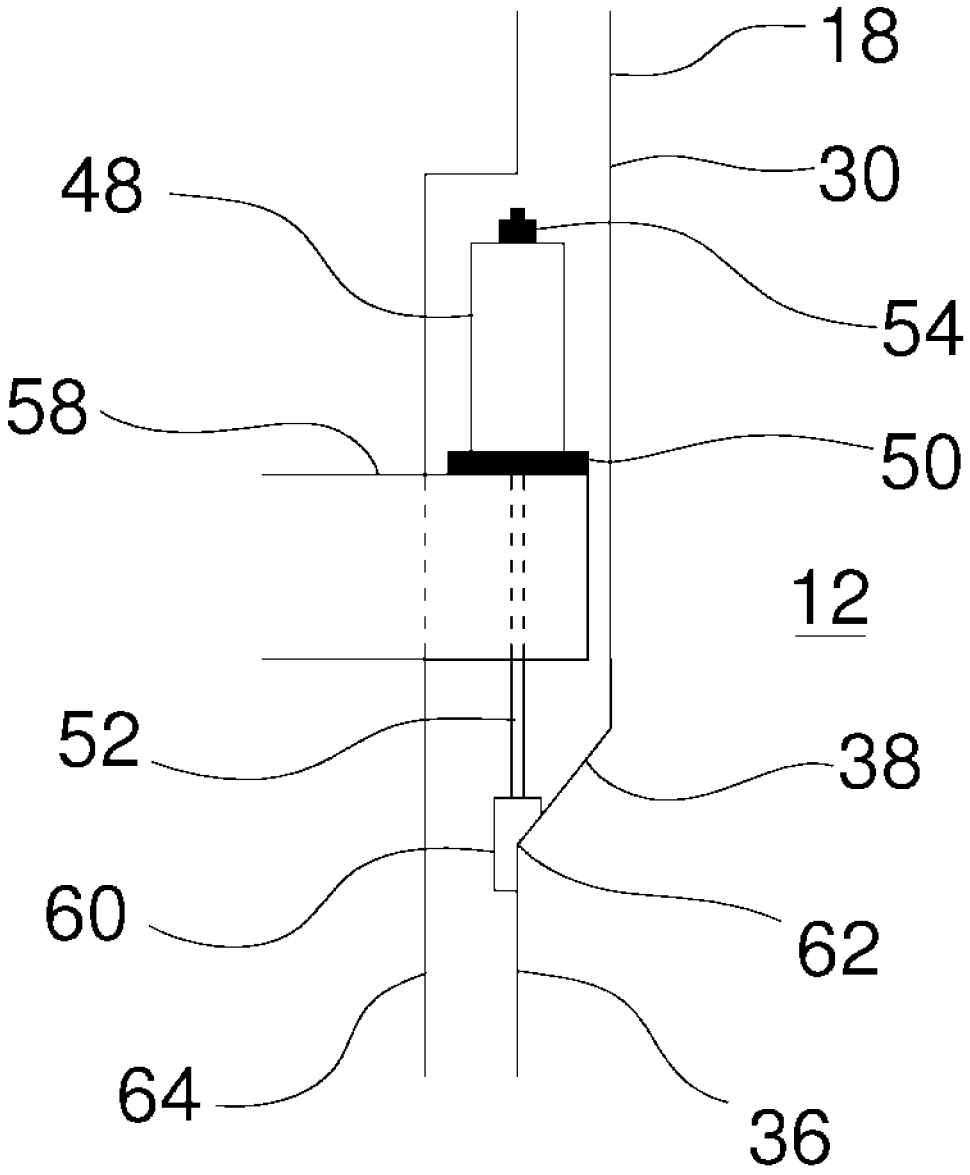
FIG. 3 schematically illustrates a detail of the suspension of a furnace according to an embodiment of the present invention.

FIG. 3 shows in more detail the suspension of the furnace 12 from the horizontal wall supporting beam 48. More particularly, FIG. 3 shows the sliding supporting of the horizontal wall supporting beam 48 by a sliding surface 50 in the location of a cantilever beam 58 that ends in the vicinity of the vertical upper portion 30 of the side wall 18. Supporting of the horizontal wall supporting beams 48 to the fixed horizontal beams 46 outside and parallel to the end walls 20 is generally similar to that shown in FIG. 3. The lower ends of the hanger rods 52 are attached by support lugs 60 to the edge 62 between the intermediate outwards bent wall portion 38 and vertical upper portion 36 of the lower portion 32 of the side wall 18. In order to maintain the horizontal wall supporting beams 48 at the same temperature with that of the furnace 12, they are covered by a common insulating layer 64.

As seen in FIG. 3, the top ends of the hanger rods 52 are fixed to the horizontal wall supporting beam 48 by suitable fixing nuts 54, or other suitable means. Locations of the hanger rods 52 along the side walls 18, on the horizontal wall supporting beams 48 were also seen in FIG. 2 on the basis of the fixing nuts 54 above the vertical upper portion 36 of the lower portion 32 of the sidewalls 18. The cantilever beams 58 may have vertical bores to run the hanger rods 52 through the cantilever beams at the location of the beams, as was shown in FIG. 2. Alternatively, the hanger rods 52 may be omitted from the locations of the cantilever beams 58.

FIG. 2 shows horizontal wall supporting beams 48 arranged on sliding surfaces 50 even on the cantilever beams 58. Alternatively, the horizontal wall supporting beams 48 could be fixed to the cantilever beams 58 at a central location of the side wall 18. It is also possible that the horizontal wall supporting beams 48 are piecewise extending, for example, from a cantilever beam 58 to a fixed horizontal beam 46 outside and parallel to an end wall 20. The parts of such a piecewise horizontal wall supporting beam are usually connected together to ensure desired longitudinal thermal movement of the piecewise wall supporting beam.

Figure 4:
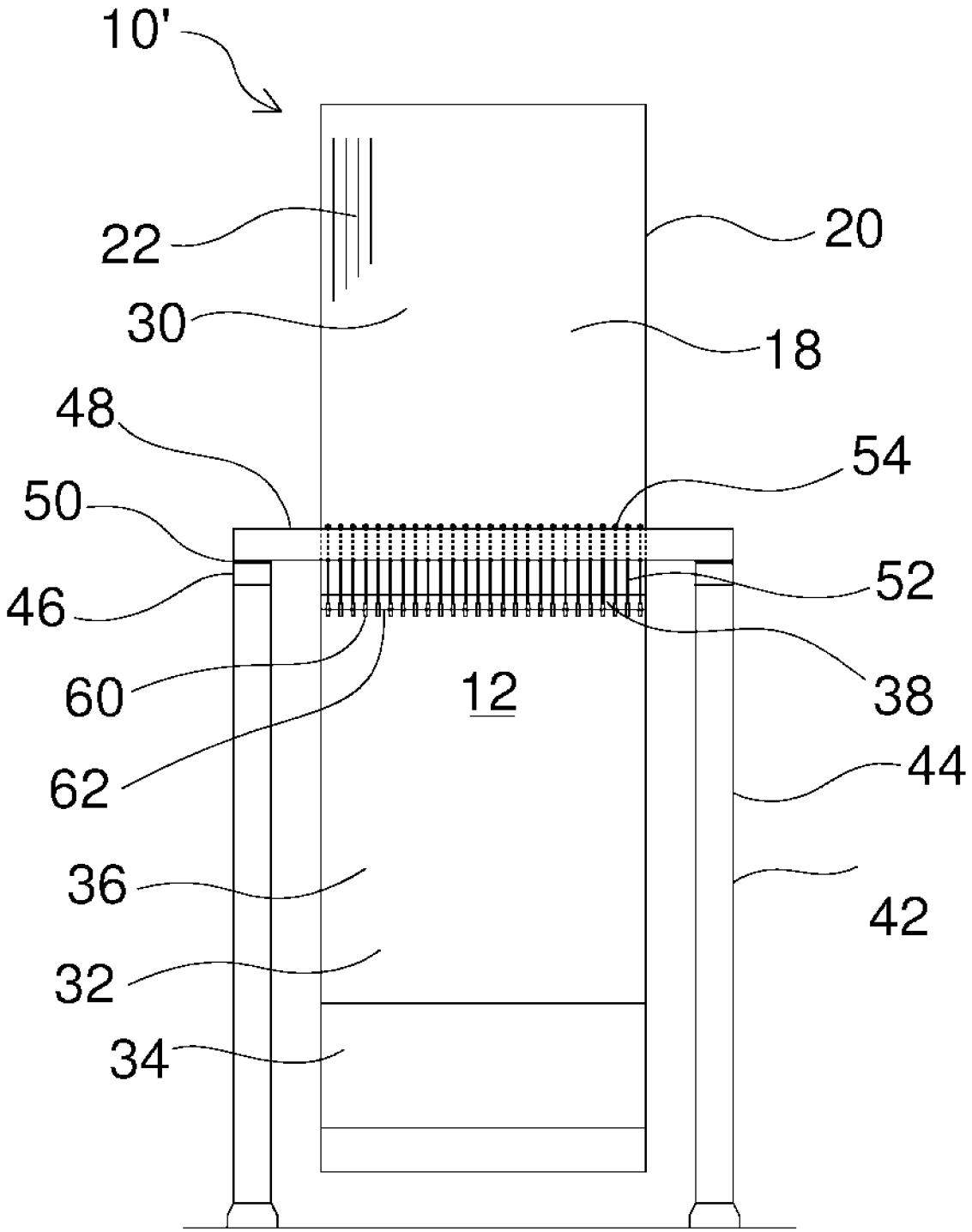
FIG. 4 schematically illustrates a side view of a boiler system according to another preferred embodiment of the present invention.

FIG. 4 schematically illustrates a side view of another boiler system 10' as seen towards a side wall 18. The boiler system 10' corresponds otherwise to the boiler system 10 shown in FIGS. 1 and 2, but it has shorter side walls 18, whereby there is no need for additional supporting of the horizontal wall supporting beams 48 by cantilever beams at a central portion of the side walls 18. FIG. 4 particularly shows that, in order to provide a nearly uniform support to the side walls 18 of the furnace 12, the multiple hanger rods 52 are at a short distance from each other. Advantageously, the distance between adjacent hanger rods 52 is a small multiple of the distance between adjacent water tubes 22 of the water tube wall. The distance of the hanger rods is thus advantageously N times the distance between adjacent water tubes 22 of the water tube wall, where N is a small integer. Preferably, N is at most three, more preferably, at most two, and, even more preferably, N is one.

According to the present invention, the horizontal wall supporting beams stay, particularly due to the thermally insulating layer 64 shown in FIG. 3, advantageously in all operating conditions at the same, or at least nearly the same, temperature as that of the furnace 12. Therefore, the thermal expansion of the horizontal wall supporting beams 48 is, in practice, identical with that of the width of the side walls 18. Due to the sliding surfaces 50, the horizontal wall supporting beams are able to slide with respect the fixed horizontal beams 46, whereby the hanger rods 52 stay during thermal expansion parallel with each other, and vertical in the direction of the plane parallel to the vertical portions of the adjacent side wall 18. In the direction of the vertical plane perpendicular to the adjacent end wall 18, the hanger rods may be uniformly tilted at a small angle that is to be taken into account in the fixing of the hanger rods to the horizontal wall supporting beams 48 and to the lugs 60.

Figure 5:
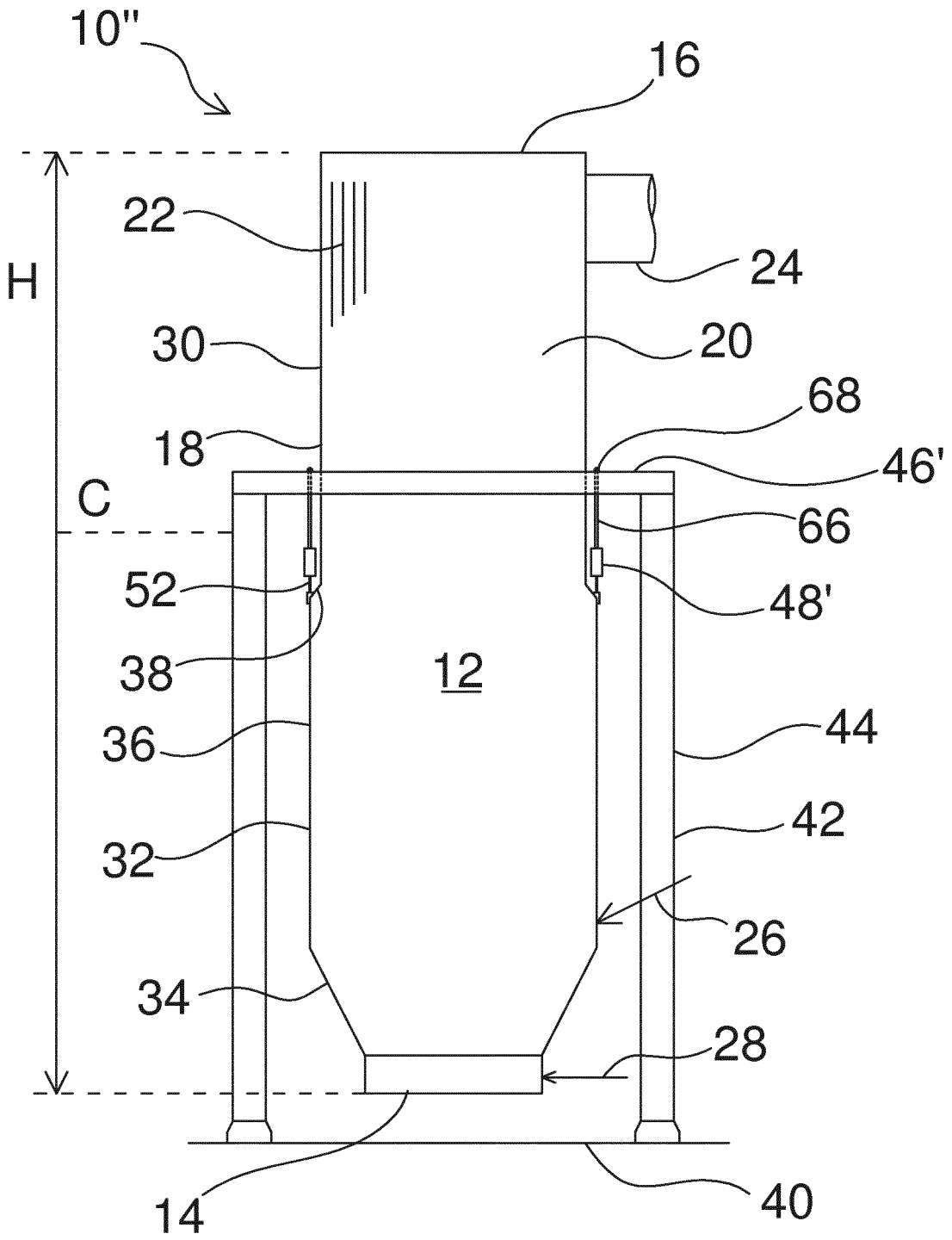
FIG. 5 schematically illustrates a side view of a boiler system according to a third preferred embodiment of the present invention.
Figure 6:
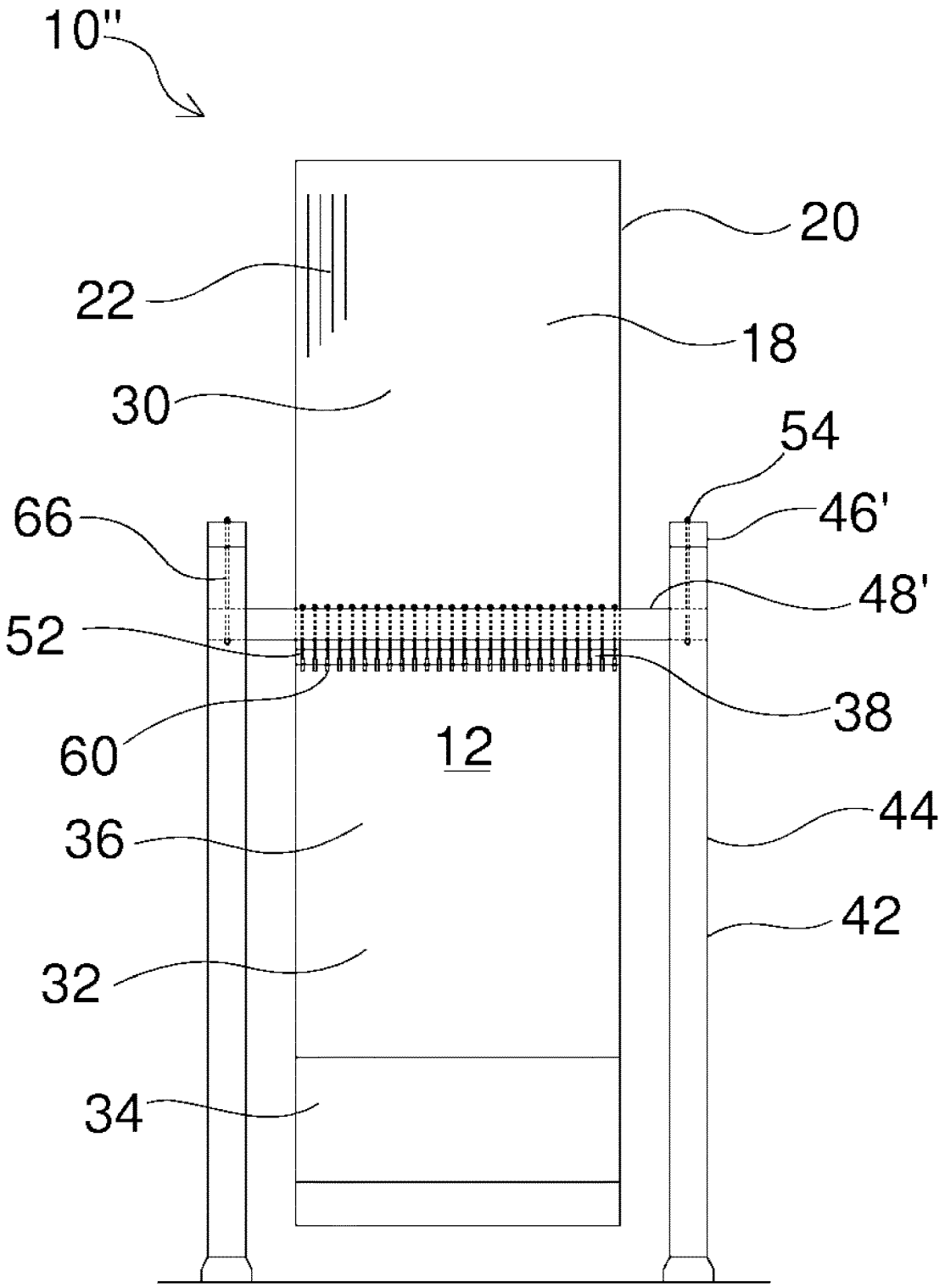
FIG. 6 schematically illustrates another side view of the boiler system of FIG. 5.

FIG. 5 schematically illustrates a side view of another embodiment of the present invention. The boiler system 10" shown in FIG. 5 differs from that of the boiler system 10 shown in FIG. 1 mainly in that the horizontal wall supporting beams 48' are not supported slidingly on fixed horizontal beams, but the horizontal wall supporting beams 48' are hanging from fixed horizontal beams 46' by main hanger rods 66. As is seen in FIG. 6, there is advantageously a single main hanger rod 66 connected to the fixed horizontal beams 46' outside and parallel to the end walls 20. It is also possible that there are cantilever beams, similarly as shown in FIG. 2, to arrange additional main hanger rods also at central portions of the horizontal wall supporting beams 48'.

The horizontal wall supporting beams 48' are advantageously inside a common insulating layer with the furnace 12, whereby the horizontal wall supporting beams 48' stay at the same temperature as that of the furnace 12. Differential horizontal thermal expansion between the horizontal wall supporting beams 48' and the fixed horizontal beams 46' is absorbed by tilting of the main hanger rods 66. In order to avoid too large tilting angles, the hanger rods have to have a sufficient length, such as at least about three meters.

Longer main hanger rods absorb horizontal thermal expansion by less tilting, but they have the disadvantage of possibly increasing the height of the support construction needed for supporting the furnace at a certain height.

It is to be understood that FIGS. 1 to 6 show only exemplary embodiments of the present invention, and features shown in the different embodiments can be changed to corresponding features shown in other embodiments, or to those based on general teaching of the present description, whenever it is technically possible.

As becomes clear from the discussion above, different embodiments of a furnace of a boiler system with a simple and reliable supporting construction are provided. It should be understood that the elements described in connection with an embodiment also can be used in other embodiments, when possible.

While the invention has been described herein by way of examples in connection with what are at present considered to be the most preferred embodiments, it is to be understood that the invention is not limited to the disclosed embodiments, but is intended to cover various combinations or modifications of its features and several other applications included within the scope of the invention as defined in the appended claims.

The invention claimed is:

1. A boiler system comprising:

a support construction; and a furnace supported to the support construction at a vertically middle section of the furnace, the furnace being enclosed by water tube walls comprising two side walls and two end walls, a roof, and a bottom, the side walls having a total height H from the bottom to the roof, wherein each of the two side walls comprises a vertical upper portion that extends from the roof to a level of thirty to seventy percent of the height H, a lower portion that extends from the bottom to a level of thirty to seventy percent of the height H and has a vertical upper portion of the lower portion of the side wall, and an in downward direction, outwards bent intermediate portion, at a level between the vertical upper portion of the side wall and the vertical upper portion of the lower portion of the side wall, wherein (i) the support construction comprises horizontal wall supporting beams at a level below the roof of the furnace, (ii) the horizontal wall supporting beams are arranged parallel to the two side walls and directly above the vertical upper portions of the lower portions of the two side walls, and (iii) the furnace is supported to the support construction by having the intermediate portions of the two side walls connected to the horizontal wall supporting beams so as to balance vertical loads of the furnace.

2. The boiler system according to claim 1, wherein the horizontal wall supporting beams are arranged at a level of thirty to seventy percent of the height H from the bottom of the furnace.

3. The boiler system according to claim 1, wherein the support construction comprises a first portion having multiple vertical columns supported to foundations of the boiler system.

4. The boiler system according to claim 3, wherein the support construction further comprises multiple fixed horizontal beams firmly supported to the vertical columns and a second portion that is movably connected to the first portion and comprises the horizontal wall supporting beams.

5. The boiler system according to claim 4, wherein each of the horizontal wall supporting beams is movably supported to at least two of the fixed horizontal beams.

6. The boiler system according to claim 5, wherein the at least two fixed horizontal beams are arranged parallel to the end walls of the furnace.

7. The boiler system according to claim 6, wherein the at least two fixed horizontal beams comprise at least two of one or more horizontal beams arranged outside an end wall of the furnace and one or more cantilever beams protruding towards a central portion of a side wall of the furnace.

8. The boiler system according to claim 7, wherein each of the horizontal wall supporting beams is supported on sliding surfaces arranged on the at least two fixed horizontal beams.

9. The boiler system according to claim 7, wherein each of the horizontal wall supporting beams is supported to be hanging by at least two main hanger rods from the at least two fixed horizontal beams.

10. The boiler system according to claim 1, wherein vertical loads of the furnace are balanced solely by the horizontal wall supporting beams.

11. The boiler system according to claim 1, wherein the horizontal wall supporting beams are arranged inside a common thermal insulation with the furnace.

12. The boiler system according to claim 1, wherein each of the intermediate portions of the side walls is supported to an adjacent horizontal wall supporting beam by a plurality of short hanger rods that are aligned with the vertical upper portion of the lower portion of the respective side wall.

13. The boiler system according to claim 12, wherein each of the short hanger rods is by a support lug attached to an outer edge of the in downward direction outwards bent intermediate portion of the respective side wall.

14. The boiler system according to claim 12, wherein the distance between adjacent hanger rods is N times the distance between adjacent vertical water tubes of the water tube wall of the respective side wall.

15. The boiler system according to claim 14, wherein N is an integer of at most three.

16. The boiler system according to claim 14, wherein N is at most two.

17. The boiler system according to claim 14, wherein N is one.

18. The boiler system according to claim 1, wherein the furnace is the furnace of a fluidized bed boiler.

* * * * *